US011125143B2

(12) United States Patent
Grosch et al.

(10) Patent No.: US 11,125,143 B2
(45) Date of Patent: Sep. 21, 2021

(54) METHODS AND SYSTEMS FOR A COOLING ARRANGEMENT

(71) Applicant: Ford Global Technologies, LLC, Dearborn, MI (US)

(72) Inventors: Guenter Grosch, Vettweiss (DE); Richard Fritsche, Wermelskirchen (DE); Hans Guenter Quix, Herzogenrath (DE); Kai Kuhlbach, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/001,841

(22) Filed: Aug. 25, 2020

(65) Prior Publication Data

US 2021/0062708 A1 Mar. 4, 2021

(30) Foreign Application Priority Data

Aug. 27, 2019 (DE) ..... 102019212801.7

(51) Int. Cl.

| | |
|---|---|
| ***F01P 7/14*** | (2006.01) |
| ***F02F 1/42*** | (2006.01) |
| ***F02F 1/36*** | (2006.01) |
| ***F01M 11/02*** | (2006.01) |
| ***F01P 3/02*** | (2006.01) |

(52) U.S. Cl.

CPC ..... *F01P 7/14* (2013.01); *F01M 11/02* (2013.01); *F01P 3/02* (2013.01); *F02F 1/36* (2013.01); *F02F 1/4264* (2013.01)

(58) Field of Classification Search

CPC .... F01P 7/14; F01P 7/167; F01P 11/08; F01P 3/02; F01M 11/02; F02F 1/36; F02F 1/4264; F02F 1/26; F02F 1/40

See application file for complete search history.

(56) References Cited

U.S. PATENT DOCUMENTS

| | | | | |
|---|---|---|---|---|
| 4,825,816 | A * | 5/1989 | Yamada | F01P 1/02 123/41.42 |
| 4,926,800 | A * | 5/1990 | Valev | F01M 1/12 123/41.08 |
| 2018/0100463 | A1* | 4/2018 | Jang | F01P 3/02 |
| 2018/0238205 | A1* | 8/2018 | Koide | F01M 9/00 |

FOREIGN PATENT DOCUMENTS

| | | | |
|---|---|---|---|
| DE | 102009028455 | A1 | 2/2011 |
| DE | 102015211549 | A1 | 1/2016 |
| DE | 102015116430 | A1 | 3/2017 |
| DE | 102017106066 | A1 | 5/2017 |
| DE | 102017217542 | A1 | 4/2019 |
| EP | 2133532 | A2 | 12/2009 |

* cited by examiner

*Primary Examiner* — Syed O Hasan

(74) *Attorney, Agent, or Firm* — Geoffrey Brumbaugh; McCoy Russell LLP

(57) ABSTRACT

Methods and systems are provided for a cooling arrangement. In one example, a plurality of engine oil passages extend through a cylinder head coolant jacket. The plurality of engine oil passages is fluidly separated from the cylinder head coolant jacket.

13 Claims, 4 Drawing Sheets

METHODS AND SYSTEMS FOR A COOLING ARRANGEMENT

CROSS REFERENCE TO RELATED APPLICATIONS

The present application claims priority to German Patent Application No. 102019212801.7 filed on Aug. 27, 2019. The entire contents of the above-listed application is hereby incorporated by reference for all purposes.

FIELD

The present description relates generally to a cooling arrangement configured to enhance thermal communication between engine oil and engine coolant.

BACKGROUND/SUMMARY

Atmospheric nitrogen may react with intake oxygen to form nitrogen oxides ($No_x$) during combustion in internal combustion engines. As such, vehicles may include after-treatment devices, such as, selective catalytic reduction (SCR) devices, $NO_x$ traps, and other reduction catalysts for reducing $NO_x$ to other species (e.g., $N_2$ and $H_2O$). Another method for reducing $NO_x$ emissions includes recirculating engine exhaust gas back to an engine intake via an exhaust gas recirculation (EGR) pathway.

However, most $NO_x$ may be formed during engine cold-start, where engine temperatures are below a desired operating temperature and a catalyst has not reached a light-off temperature. EGR may not be used during cold-start such that the engine may reach the desired operating temperature more quickly. As such, cold-starts may produce larger amounts of greenhouse emissions during operating conditions where the emissions may not be treated to desired levels. Thus, it is desired to either reduce a duration of the cold-start.

In one example, the issues described above are at least partially solved by a system comprising a cylinder head comprising an exhaust passage and a coolant jacket, wherein a plurality of engine oil passages extend through the coolant jacket. In this way, the engine oil may be quickly heated and the cold-start duration may be reduced.

As one example, a single engine oil passage splits into the plurality of engine oil passages outside of the coolant jacket. The plurality of engine oil passages may be arranged in a matrix or grid pattern wherein one or more connecting elements extend between adjacent oil passages. The connecting elements may enhance thermal transfer from the coolant in the coolant jacket to the engine oil passages. By doing this, the engine oil may heat up more quickly and reduce the cold-start duration.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1B:
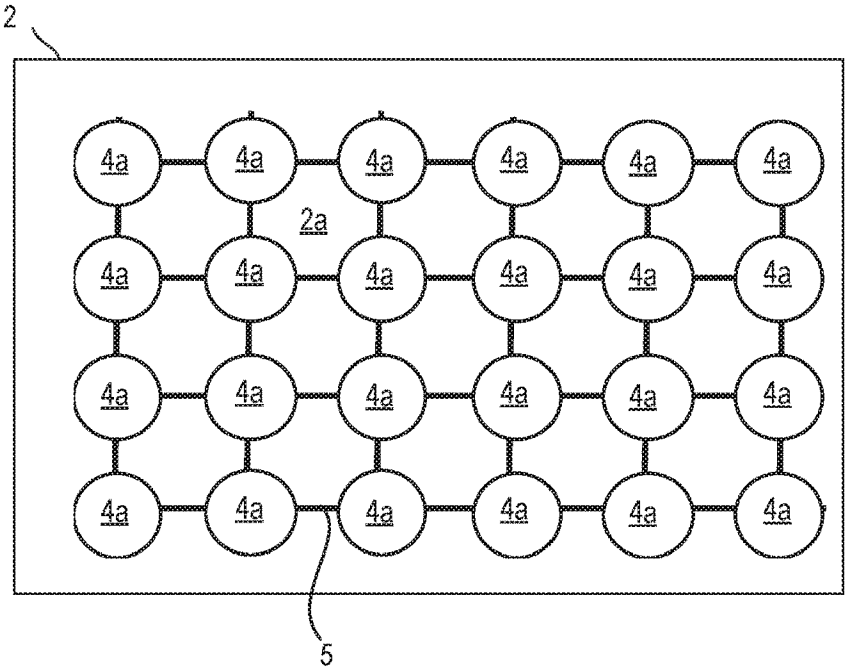
FIG. 1*b* schematically shows, in cross section, the line system implemented in the coolant jacket of the cylinder head illustrated in FIG. 1*a;*

The following description relates to systems and methods for a cooling arrangement. In one example, a liquid-cooled internal combustion engine comprises at least one cylinder with at least one cylinder head and one cylinder block. Each cylinder has at least one inlet opening for the supply of fresh air via an intake system and at least one outlet opening for the discharge of the exhaust gases via an exhaust-gas discharge system, each inlet opening being adjoined by an intake line and each outlet opening being adjoined by an exhaust line. The at least one cylinder head is equipped with at least one integrated coolant jacket, said at least one cylinder-head-associated coolant jacket having, at the inlet side, a supply opening for the feed of coolant and, at the outlet side, a discharge opening for the discharge of the coolant. The discharge opening is connected to the supply opening so as to form a coolant circuit, the coolant circuit being equipped with a coolant control unit. A pump serves for conveying engine oil specifically via the feed line to at least one consumer within an oil circuit.

An internal combustion engine of the stated type is used as a motor vehicle drive. Within the context of the present disclosure, the expression "internal combustion engine" encompasses Otto-cycle engines and diesel engines but also hybrid internal combustion engines, which utilize a hybrid combustion process, and hybrid drives which, in addition to the internal combustion engine, comprise at least one further torque source for driving a motor vehicle, for example an electric machine which is or can be connected in terms of drive to the internal combustion engine and which outputs power instead of or in addition to the internal combustion engine.

It is basically possible for the cooling arrangement of an internal combustion engine to take the form of an air-type cooling arrangement or a liquid-type cooling arrangement. On account of the higher heat capacity of liquids, it is possible for significantly greater quantities of heat to be dissipated using a liquid-type cooling arrangement than is possible using an air-type cooling arrangement. Therefore, internal combustion engines according to the previous example are ever more frequently being equipped with a liquid-type cooling arrangement, because the thermal loading of the engines is constantly increasing. Another reason for this is that internal combustion engines are increasingly being supercharged and—with the aim of obtaining the densest packaging possible, an ever greater number of components are being integrated into the cylinder head or cylinder block, as a result of which the thermal loading of the engines, that is to say of the internal combustion engines, is increasing. The exhaust manifold is increasingly commonly being integrated into the cylinder head in order to be incorporated into a cooling arrangement provided in the cylinder head and in order that the manifold may not be produced from thermally highly loadable materials, which are expensive.

The formation of a liquid-type cooling arrangement demands that the cylinder head be equipped with at least one coolant jacket, that is to say necessitates the provision of coolant ducts which conduct the coolant through the cylinder head. The at least one coolant jacket is fed with coolant at the inlet side via a supply opening, which coolant, after flowing through the cylinder head, exits the coolant jacket at the outlet side via a discharge opening. The heat may not first be conducted to the cylinder head surface in order to be dissipated, as is the case in an air-type cooling arrangement, but rather is discharged to the coolant already in the interior of the cylinder head. Here, the coolant is delivered by means of a pump arranged in the coolant circuit, such that said coolant circulates. The heat which is discharged to the coolant is thereby discharged from the interior of the cylinder head via the discharge opening, and is extracted from the coolant again outside the cylinder head, for example by means of a heat exchanger and/or in some other way.

Like the cylinder head, the cylinder block may also be equipped with one or more coolant jackets. The cylinder head is however the thermally more highly loaded component because, by contrast to the cylinder block, the cylinder head is provided with exhaust-gas-conducting lines, and the combustion chamber walls which are integrated in the cylinder head are exposed to hot exhaust gas for longer than the cylinder barrels or cylinder bores provided in the cylinder block. Furthermore, the cylinder head has a lower component mass than the block.

As coolant, use is generally made of a water-glycol mixture provided with additives. In relation to other coolants, water has the advantage that it is non-toxic, readily available and cheap, and furthermore has a very high heat capacity, for which reason water is suitable for the extraction and dissipation of very large amounts of heat, which is basically considered to be advantageous.

To form a coolant circuit, the outlet-side discharge opening from which the coolant exits can be or is connected to the inlet-side supply opening which serves for the feed of coolant to the coolant jacket, for which purpose a line or multiple lines may be provided. Said lines may not be lines in the physical sense but rather may also be integrated in portions into the cylinder head, the cylinder block or some other component. An example of such a line is a recirculation line in which a heat exchanger is arranged in order to extract heat from the coolant.

It is not the aim and the purpose of a liquid-type cooling arrangement to extract the greatest possible amount of heat from the internal combustion engine under all operating conditions. Rather, what is sought is demand-dependent control of the liquid-type cooling arrangement, which aside from full load also makes allowance for the operating modes of the internal combustion engine in which it is more advantageous for less heat, or as little heat as possible, to be extracted from the internal combustion engine.

To reduce the friction losses and thus the fuel consumption of an internal combustion engine, fast warming of the engine oil, in particular after a cold start, may be expedient. Fast warming of the engine oil during the warm-up phase of the internal combustion engine ensures a correspondingly fast decrease in the viscosity of the oil and thus a reduction in friction and friction losses, in particular in the bearings which are supplied with oil, for example the bearings of the crankshaft.

Numerous concepts are known from the previous examples by means of which the friction losses can be reduced by means of fast warming of the engine oil. The oil may for example be actively heated by means of an external heating device, wherein the heating device however consumes additional fuel, which counteracts a reduction in fuel consumption. Other concepts provide that the engine oil heated during operation be stored in an insulated vessel and utilized upon a restart, wherein the oil heated during operation cannot be held at a high temperature for an unlimited amount of time. In a further concept, in the warm-up phase, a coolant-operated oil cooler is utilized, contrary to its intended purpose, for warming the oil, though this in turn assumes fast warming of the coolant.

Fast warming of the engine oil in order to reduce friction losses may basically also be promoted by means of fast heating of the internal combustion engine itself, which in turn is assisted, that is to say forced, by virtue of as little heat as possible being extracted from the internal combustion engine during the warm-up phase.

In this respect, the warm-up phase of the internal combustion engine after a cold start is an example of an operating mode in which it is advantageous for as little heat as possible, in one example no heat, to be extracted from the internal combustion engine.

Control of the liquid-type cooling arrangement in which the extraction of heat after a cold start is reduced for the purpose of fast heating of the internal combustion engine may be realized through the use of a temperature-dependently self-controlling valve, often also referred to in the previous example as a thermostat valve. A thermostat valve of said type has a temperature-reactive element which is impinged on by coolant, wherein a connecting line which leads through the valve is blocked or opened up—to a greater or lesser extent—as a function of the coolant temperature at the element.

In an internal combustion engine which has both a liquid-cooled cylinder head and also a liquid-cooled cylinder block, it is advantageous for the coolant throughput through the cylinder head and through the cylinder block to be controllable independently of one another and preferably in continuously variable fashion, in particular because the two components are thermally loaded to different degrees and exhibit different warm-up behavior. In this regard, it would be expedient for the coolant stream through the cylinder head and the coolant stream through the cylinder block to be controlled in each case by means of a dedicated thermostat valve with different opening temperatures. At the start of the warm-up phase, the coolant would not flow but rather would remain stationary in the lines and in the coolant jacket of the cylinder head and/or of the cylinder block, whereby the warming of the coolant and the heating of the internal combustion engine would be accelerated, the warming of the engine oil would be expedited and the reduction in friction losses would be assisted.

For comfort reasons, it may be advantageous or desirable, in particular after a cold start, for a coolant-operated vehicle interior heater to be fed, via a heating circuit line, with coolant that has been pre-warmed in the cylinder head and/or cylinder block.

Embodiments are known from the previous example in which a so-called proportional valve is provided at the outlet side or at the inlet side for the control of the liquid-type cooling arrangement, which proportional valve controls both the coolant flow through the cylinder head and also the coolant flow through the cylinder block by means of a single setting element, and by means of which proportional valve demand-dependent control of the liquid-type cooling arrangement, and demand-dependent cooling of the internal combustion engine, can be realized. The costs, weight and spatial requirement for the control are reduced. The number of components is reduced, as a result of which the procurement costs and assembly costs are fundamentally reduced. The setting element may for example take the form of a rotatable drum with openings arranged on the shell surface, wherein multiple inputs and outputs for the coolant are provided in the valve housing that accommodates the setting element.

The proportional valve, which is for example actively controlled by means of the engine controller, basically permits characteristic-map-controlled actuation and thus also a coolant temperature that is adapted to the present load state of the internal combustion engine, for example a higher coolant temperature at relatively low loads than at high loads, and thus less extraction of heat in part-load operation. By means of a proportional valve which is controlled by means of the engine controller, the flows of coolant through the cylinder head and the cylinder block and thus the extracted heat quantities can be adjusted, that is to say controlled, according to demand.

To at least partially solve the issues stated above, a liquid-cooled internal combustion engine which is improved with regard to cold-starting behavior or warm-up and in the case of which, in particular, faster heating of the engine oil can be realized, such that friction losses can be reduced is described herein.

In one embodiment, a liquid-cooled internal combustion engine comprises at least one cylinder with at least one cylinder head and one cylinder block, in which internal combustion engine each cylinder has at least one inlet opening for the supply of fresh air via an intake system and at least one outlet opening for the discharge of the exhaust gases via an exhaust-gas discharge system, each inlet opening being adjoined by an intake line and each outlet opening being adjoined by an exhaust line, the at least one cylinder head is equipped with at least one integrated coolant jacket, said at least one cylinder-head-associated coolant jacket having, at the inlet side, a supply opening for the feed of coolant and, at the outlet side, a discharge opening for the discharge of the coolant, the discharge opening is connected to the supply opening so as to form a coolant circuit, the coolant circuit being equipped with a coolant control unit, and a pump serves for conveying engine oil specifically via the feed line to at least one consumer within an oil circuit, and which internal combustion engine is distinguished by the fact that the oil circuit has a line system with at least one line, at least one line of the line system being arranged in a cylinder-head-associated coolant jacket such that said at least one line is, at least in certain portions, surrounded over a full periphery by coolant.

In order to realize faster heating of the engine oil after a cold start or during the warm-up, the internal combustion engine according to the disclosure has a heat exchanger by means of which heat from the coolant of the coolant circuit can be introduced into the engine oil of the oil circuit. Here, use is made of the effect that the coolant of an internal combustion engine generally warms up more quickly than the engine oil.

The heat exchanger according to the disclosure is formed by a line system which has at least one line and which is fluidically connected to the oil circuit of the internal combustion engine. Said line system is consequently flowed through by engine oil originating from the oil circuit.

At least one line of the line system is positioned in a coolant jacket of the cylinder head of the internal combustion engine, specifically such that said at least one line is, at least in certain portions, enveloped by coolant over a full periphery, whereby the heat transfer is promoted.

The arrangement of the line system in the coolant jacket should basically be such that as large as possible a heat-transferring surface is created and as great as possible a heat quantity can be transferred from the coolant to the engine oil.

This can be achieved in particular by virtue of the line system being positioned at a location of the cylinder head at which higher temperatures are attained more quickly after a cold start than at other locations of the cylinder head, which generally does not exhibit uniform warm-up behavior but rather has a highly inhomogeneous temperature distribution in the warm-up phase.

With the internal combustion engine according to the disclosure, the object on which the disclosure is based is achieved, that is to say an internal combustion engine is provided which is improved with regard to cold-starting behavior or warm-up and in the case of which, in particular, faster heating of the engine oil can be realized, such that friction losses can be reduced.

Embodiments of the liquid-cooled internal combustion engine are advantageous in which the line system comprises a plurality of lines.

In the context of the present disclosure, a plurality of lines means at least two lines, at least three lines or at least four lines, but in particular five or more lines, six, seven, eight, nine, ten or more lines. A line system may however also comprise twelve or more, fifteen or more or twenty or more lines.

The heat-transferring surface, that is to say the surface which is impinged on from the outside by coolant, also increases in size with the number of lines. A larger surface permits greater heat transfer via heat conduction, and in the case of circulating coolant greater heat transfer owing to convection.

Embodiments of the liquid-cooled internal combustion engine are advantageous in which multiple lines have an identical orientation.

In the context of the present disclosure, multiple lines are at least two lines, but generally at least three, four or more lines, up to an entire cluster of lines.

An identical orientation of the lines allows multiple lines to be arranged in the smallest possible volume, that is to say makes it possible to realize the largest possible heat-transferring surface with at the same time the smallest possible volume.

Embodiments of the liquid-cooled internal combustion engine are advantageous in which multiple lines are arranged spaced apart from one another.

The spacing of the lines is intended to permit a through-flow of coolant between the lines and thus improve, in particular increase, the heat transfer.

Embodiments of the liquid-cooled internal combustion engine are advantageous in which multiple lines are fluidically connected to one another. For this purpose, said lines may be fed with engine oil using a single line.

Therefore, embodiments of the liquid-cooled internal combustion engine are also advantageous in which multiple lines merge to form a common line.

Embodiments of the liquid-cooled internal combustion engine are advantageous in which multiple lines are connected to one another using individual intermediate elements and form a coherent structure.

The intermediate elements provide the structure with a certain stiffness and defined dimensions. Both of these are advantageous. Firstly, the structure should have a certain stiffness and thus durability, wherein it may be considered that the structure is flowed around by coolant and cavitation may also occur in certain places, in particular regions of high thermal loading. Secondly, the structure may be introduced, that is to say installed, into the coolant jacket, for which reason defined dimensions are desired.

In this context, embodiments of the liquid-cooled internal combustion engine are advantageous in which the intermediate elements are of rib-like form.

The rib-like form of the intermediate elements assists the heat transfer from the coolant into the structure and from the structure into the engine oil.

In this context, embodiments of the liquid-cooled internal combustion engine are likewise advantageous in which the intermediate elements are of web-like form.

Web-like intermediate elements are directed less to the heat transfer and more to the stiffness of the structure.

If intermediate elements are used, embodiments of the liquid-cooled internal combustion engine may be advantageous in which in each case two adjacent lines are connected to one another using two or more intermediate elements, adjacent intermediate elements being arranged spaced apart from one another. The spacing of the intermediate elements is intended to permit a throughflow of coolant between the lines and thus improve, in particular increase, the heat transfer.

Embodiments of the liquid-cooled internal combustion engine are advantageous in which at least one line of the line system is arranged in a region of the cylinder-head-associated coolant jacket which extends adjacent to the exhaust-gas discharge system.

Like the cylinder head, the coolant situated in a cylinder-head-associated coolant jacket does not warm up uniformly after a cold start, such that a highly inhomogeneous temperature distribution in the coolant can arise during the warm-up.

In order to be able to transfer the greatest possible amount of heat from the coolant to the engine oil after a cold start, the line system should basically be arranged in the coolant jacket at a location at which high coolant temperatures are attained quickly after a cold start, for example adjacent to the exhaust-gas discharge system. For this reason, the arrangement of the line system in a coolant jacket provided at the outlet side in the cylinder head is also suitable.

For the reasons stated above, embodiments of the liquid-cooled internal combustion engine are also advantageous in which at least one line of the line system is arranged in a region of the cylinder-head-associated coolant jacket which extends along an exhaust line.

In the case of liquid-cooled internal combustion engines in which the at least one cylinder head has at least two outlet openings, each outlet opening being adjoined by an exhaust line, embodiments are advantageous which are distinguished by the fact that the exhaust lines merge to form an overall exhaust line within the cylinder head, thus forming an integrated exhaust manifold.

In the case of liquid-cooled internal combustion engines in which the at least one cylinder head can be connected at an assembly end side to the cylinder block, in this context embodiments are advantageous which are distinguished by the fact that the at least one cylinder head has a lower coolant jacket, which is arranged between the exhaust lines and the assembly end side of the cylinder head, and an upper coolant jacket, which is arranged on that side of the exhaust lines which is situated opposite the lower coolant jacket.

In the case of a cylinder head with integrated exhaust manifold, a coolant jacket which comprises a lower coolant jacket and an upper coolant jacket has proven to be particularly advantageous. This concept permits effective cooling and a high level of heat dissipation.

The second sub-object on which the disclosure is based, specifically that of specifying a method for operating a liquid-cooled internal combustion engine of a type described above, is achieved by means of a method which is distinguished by the fact that, after a cold start and/or in a warm-up phase of the internal combustion engine, a no-flow strategy with regard to the at least one cylinder head is implemented using the coolant control unit, in which no-flow strategy the coolant in the at least one cylinder-head-associated coolant jacket does not circulate but is at a standstill.

That which has been stated in connection with the internal combustion engine according to the disclosure likewise applies to the method according to the disclosure.

To reduce the friction losses and thus the fuel consumption of an internal combustion engine, the fastest possible warming of the engine oil is sought. Fast warming of the engine oil is promoted by fast heating of the coolant. The latter is assisted in that, by means of the no-flow strategy, the coolant situated in the cylinder head is heated more quickly, whereby, in turn, the heat transfer from the coolant to the engine oil is increased. Here, the coolant in the at least one cylinder-head-associated coolant jacket does not circulate.

Method variants are advantageous in which, after a cold start and/or in a warm-up phase of the internal combustion engine, a no-flow strategy with regard to the line system is implemented, in which no-flow strategy the engine oil in the line system does not circulate but is at a standstill.

In the present case, the engine oil in the line system does not circulate. There is nevertheless a mitigated likelihood of overheating of the engine oil and thus thermal aging, in particular coking, because the coolant does not under any operating conditions attain the very high temperatures required for this.

Method variants are also advantageous in which, after a cold start and/or in a warm-up phase of the internal combustion engine, a no-flow strategy with regard to the oil circuit is implemented using the pump, in which no-flow strategy the engine oil in the oil circuit does not circulate but is at a standstill. That which has been stated for the method variant described above applies.

In the present case, the delivery of the oil in the entire oil circuit is stopped by virtue of the pump for conveying the engine oil being deactivated. By contrast, the previous method variant is directed to a no-flow strategy of the line system.

Method variants are advantageous in which the no-flow strategy with regard to the line system or the no-flow strategy with regard to the oil circuit is ended as soon as the temperature of the coolant overshoots a predefinable coolant temperature. Heat can then be dissipated from the coolant by means of engine oil circulating in the line system.

In this context, method variants are advantageous in which the no-flow strategy is implemented again as soon as the temperature of the engine oil overshoots a predefinable oil temperature. This prevents a continued introduction of high quantities of heat into the engine oil.

The two latter method variants are suitable in particular for the operation of a liquid-cooled internal combustion engine which has been heated up to operating temperature, and are less commonly used after a cold start and/or in the warm-up phase of the internal combustion engine.

Figure 1A:
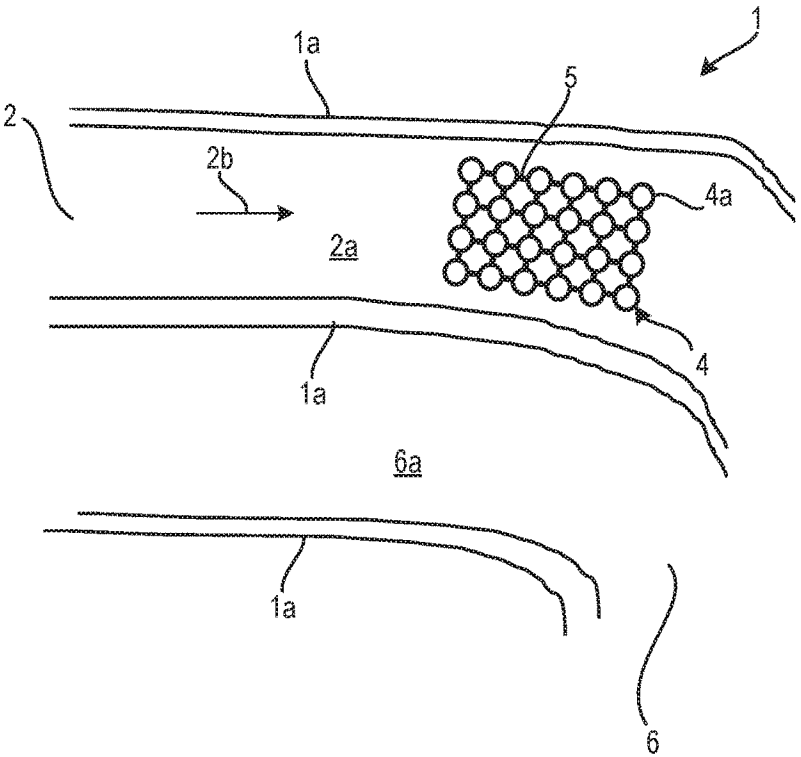
FIG. 1*a* schematically shows, in cross section, a fragment of a liquid-cooled cylinder head of a first embodiment of the internal combustion engine.

FIG. 1*a* schematically shows, in cross section, a fragment of a liquid-cooled cylinder head 1 of a first embodiment of the internal combustion engine. To form a liquid-type cooling arrangement, the internal combustion engine comprises this liquid-cooled cylinder head 1, which is connected (not illustrated) at its assembly end side to a cylinder block.

The liquid-cooled cylinder head 1 has an integrated coolant jacket 2, which is fed with coolant 2*b* from the coolant circuit of the internal combustion engine. Furthermore, the cylinder head 1 is equipped with exhaust lines 6*a* which adjoin the outlet openings of the cylinders in order to discharge the exhaust gases from the cylinders via an exhaust-gas discharge system 6. Both the coolant jacket 2 and the exhaust lines 6*a* of the exhaust-gas discharge system 6 are delimited and jointly formed by walls 1*a* of the cylinder head 1.

In the present case, the coolant jacket 2 is an upper coolant jacket 2*a* which is arranged on that side of the exhaust lines 6*a* which is averted from the cylinder block, that is to say above the exhaust manifold.

A line system 4 is provided which is connected to the oil circuit 3 (see FIG. 2) of the internal combustion engine and which is fed with engine oil 3*a* (see FIG. 2) from said oil circuit 3. Said line system 4 comprises multiple lines 4*a* which are arranged in the upper coolant jacket 2*a* of the cylinder head 1, specifically such that said lines 4*a* are, at least in certain portions, enveloped by coolant 2*b* over a full periphery.

The line system 4 is arranged in a region of the cylinder-head-associated coolant jacket 2, 2*a* which is situated adjacent to the exhaust-gas discharge system 6, and thus in a region which is thermally highly loaded. The coolant 2*b* reaches higher temperatures more quickly at this location after a cold start of the internal combustion engine, whereby the heating effect of the engine oil 3*a* by means of coolant 2*b* is assisted.

FIG. 1*b* schematically shows, in cross section, this line system 4 implemented in the coolant jackets 2, 2*a* of the cylinder head 1 as per FIG. 1*a*.

The lines 4*a* of the line system 4 have an identical orientation and run parallel to and spaced apart from one another.

The lines 4*a* are connected to one another in pairwise fashion using intermediate elements 5 and form a coherent—in the present case symmetric—structure.

The illustrated structure ensures that the lines 4*a* which conduct engine oil 3*a* are enveloped, and can be flowed around, by coolant 2*b* of the coolant jacket 2 over as large an area as possible. That is to say, mixing between the engine oil and the coolant is blocked. In this way, coolant does not enter the lines 4*a* and engine oil does not enter the coolant jacket 2.

Figure 2:
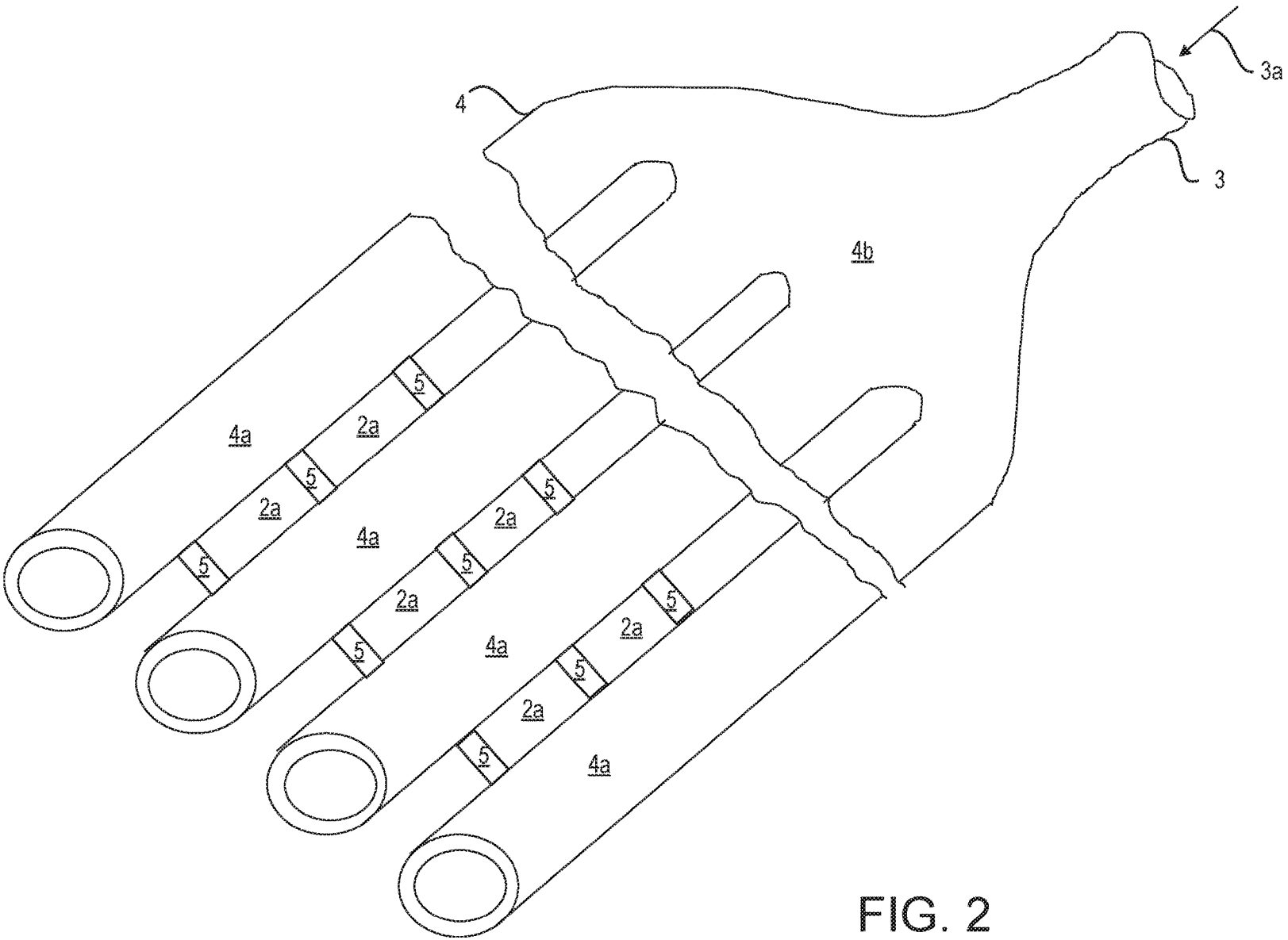
FIG. 2 schematically shows, in a perspective illustration, the line system implemented in the coolant jacket of the cylinder head illustrated in FIG. 1*a;*

FIG. 2 schematically shows, in a perspective illustration, the line system 4 implemented in the coolant jackets 2, 2*a* of the cylinder head 1 as per FIG. 1*a*.

The illustrated lines 4*a* lead to a common line 4*b*, such that the lines 4*a* are fluidically connected to one another and can be fed with engine oil using the common line 4*b*. The rib-like form of the intermediate elements 5 can be seen.

The intermediate elements 5 run in the manner of webs between two adjacent lines 4*a*. In each case two adjacent lines 4*a* are connected to one another using three intermediate elements 5, wherein the intermediate elements 5 are arranged spaced apart from one another. The spacing of the intermediate elements 5 is intended to permit the through-flow of coolant 2*b* between the lines 4*a* and thus increase the heat transfer.

In one example, the intermediate elements 5 may function as supporting elements, wherein each intermediate element is a single piece physically coupled to an outer surface of one line of the lines 4*a* at a first extreme end and to an outer surface of a different line of the lines 4*a* at a second extreme end opposite the first extreme end. The intermediate elements 5 may be hollow in one embodiment. Additionally or alternatively, the intermediate elements 5 may comprise a thermally conducting material within an interior volume. As such, the intermediate elements 5 may enhance thermal communication between the coolant 2*a* and engine oil in the lines 4*a*.

As described above, the lines 4*a* and the intermediate elements 5 are arranged in a web-like manner. That is to say, the lines 4*a* may be arranged in a matrix, wherein intermediate elements 5 are arranged between adjacent lines 4*a*. Thus, if one line of the lines 4*a* is adjacent to four other lines 4*a*, then there may be four intermediate elements, with each of the intermediate elements being physically coupled to the one line and at least one of the four other lines. In this way, the intermediate elements 5 may be arranged perpendicularly (e.g., 90°) relatively to one another.

In one example, the matrix of the lines 4*a* comprises a plurality of outer lines and a plurality of inner lines. Each of the plurality of outer lines may be physically coupled to three of the intermediate elements 5. Each of the plurality of inner lines may be physically coupled to four of the intermediate elements 5.

The lines 4*a* are arranged within the coolant jacket 2 such that the flow of coolant 2*b* is in a direction normal to the flow of oil 3*a*. By arranging the lines 4*a* normally to a direction of coolant flow, turbulence may increase, which may increase thermal communication between the coolant and the oil. In one example, the engine coolant and the engine oil are different liquids.

Figure 3:
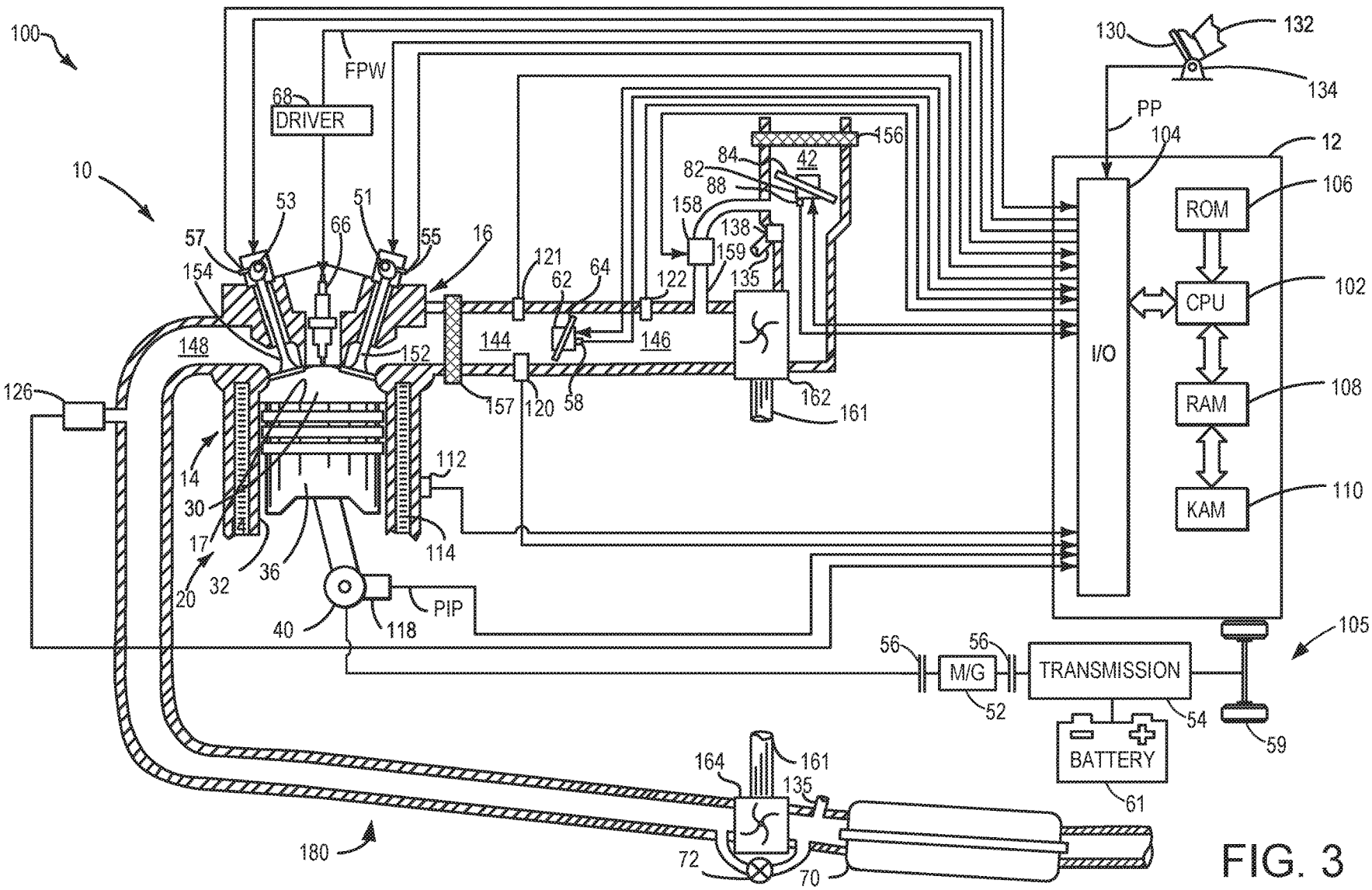
FIG. 3 shows an engine of a hybrid vehicle comprising a cooling arrangement.

FIG. 3 depicts an engine system 100 for a vehicle. The vehicle may be an on-road vehicle having drive wheels which contact a road surface. Engine system 100 includes engine 10 which comprises a plurality of cylinders. FIG. 3 describes one such cylinder or combustion chamber in detail. The various components of engine 10 may be controlled by electronic engine controller 12.

Engine 10 includes a cylinder block 14 including at least one cylinder bore, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore may be fluidly sealed, such that gases may not enter or leave the combustion chamber 30.

Additionally or alternatively, as described above, the intake valves 152 and the exhaust valves 154 may be operated via a electrohydraulically fully variable controller. In one example, the intake valves 152 or the exhaust valves 154 may be operated via the opening profiles illustrated in FIGS. 6*b* and 6*c*.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug for initiating combustion. Ignition system 190 can provide an ignition spark to cylinder 14 via spark plug in response to spark advance signal SA from controller 12, under select operating modes. However, in some embodiments, spark plug may be omitted, such as where engine 10 may initiate combustion by auto-ignition or by injection of fuel as may be the case with some diesel engines.

Fuel injector 66 may be configured to inject directly into the combustion chamber 30. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 3). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 3, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 3 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In an aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 105 may be a hybrid vehicle with multiple sources of torque available to one or more vehicle wheels 59. In other examples, vehicle 105 is a conventional vehicle with only an engine, or an electric vehicle with only electric machine(s). In the example shown, vehicle 105 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 61 to provide torque to vehicle wheels 59. Electric machine 52 may also be operated as a generator to provide electrical power to charge battery 61, for example during a braking operation.

The controller 12 receives signals from the various sensors of FIG. 3 and employs the various actuators of FIG. 3 to adjust engine operation based on the received signals and instructions stored on a memory of the controller. For example, adjusting operation of the electric machine 52 may occur based on feedback from ECT sensor 112. As will be described in greater detail below, the engine 10 and electric machine 52 may be adjusted such that their operations may be delayed based on one or more of a powertrain temperature, which may be estimated based on feedback from ECT sensor 112, and a distance between an intended destination and an electric-only operation range.

FIGS. 1*a*, 1*b*, 2, and 3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 4:
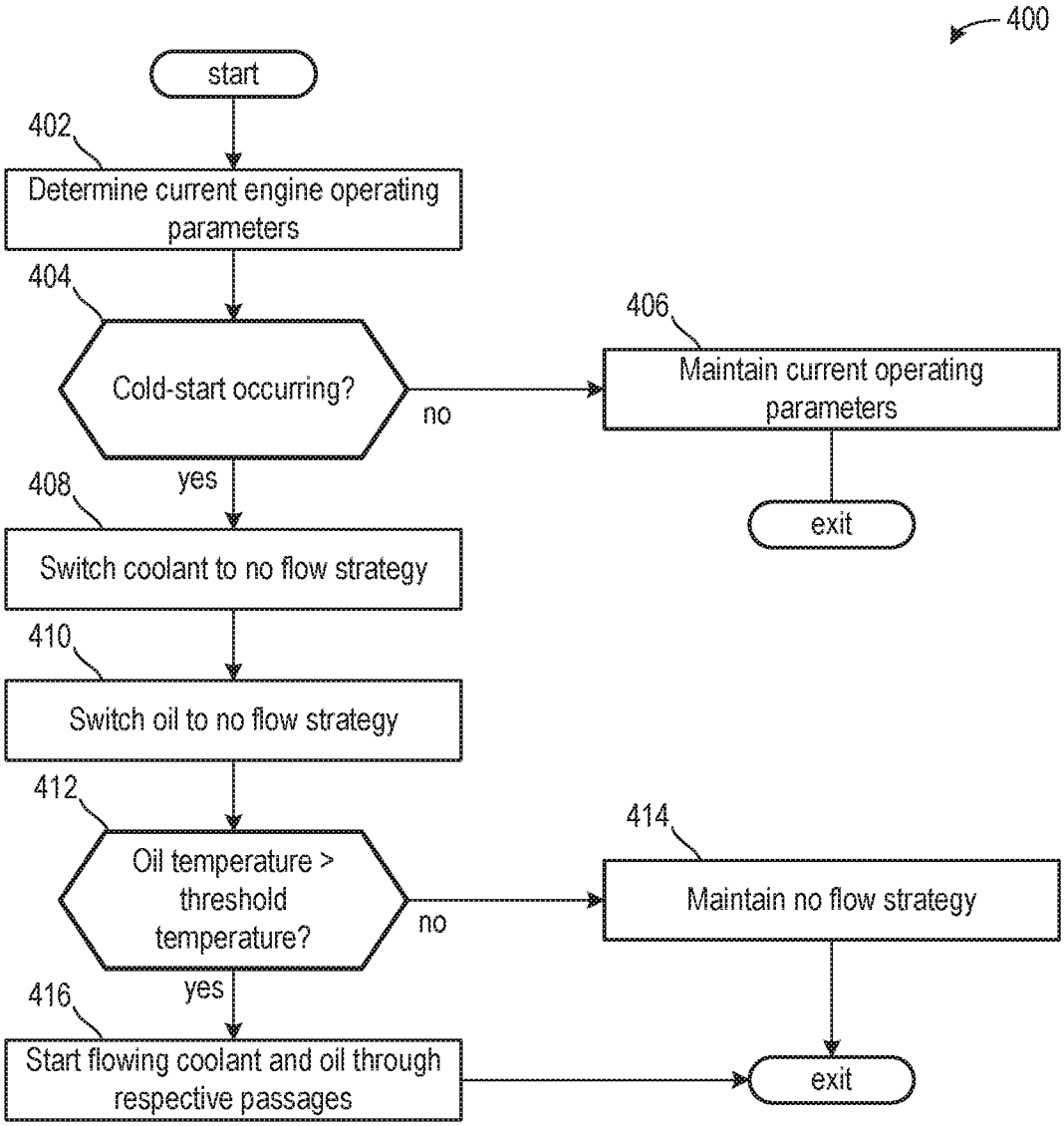
FIG. 4 shows a method for operating the cooling arrangement during a cold-start of the engine.

Turning now to FIG. 4, it shows a method 400 for adjusting a coolant flow and oil flow strategy in response to a cold-start. Instructions for carrying out method 400 may be executed by a controller based on instructions stored on a memory of the controller and in conjunction with signals received from sensors of the engine system, such as the sensors described above with reference to FIG. 3. The controller may employ engine actuators of the engine system to adjust engine operation, according to the method described below.

The method 400 begins at 402, which includes determining current engine operating parameters. Current engine operating parameters may include but are not limited to one or more of a throttle position, an engine speed, an engine temperature, a manifold vacuum, an EGR flow rate, and an air/fuel ratio.

The method 400 proceeds to 404, which includes determining if a cold-start is occurring. A cold-start may be occurring if an engine temperature is less than a threshold engine temperature. In one example, the threshold engine temperature is based on an ambient temperature. The engine temperature may be estimated based on a coolant temperature, engine oil temperature, or based on a combination of an engine off duration and an ambient temperature.

If a cold-start is not occurring, then the method 400 proceeds to 406, which includes maintaining current operating parameters. In this way, operating parameters are not adjusted to decrease a duration of the cold-start.

If a cold-start is occurring, then the method 400 proceeds to 408, which includes switching a coolant flow to a no flow strategy. In one embodiment, the no flow strategy comprises halting flow of the coolant through one or more of the cylinder head coolant jacket and the cylinder block coolant jacket. In this way, coolant in the cylinder head and the cylinder block may be rapidly heated via latent heat from combustion.

The method 400 proceeds to 410, which includes switching an engine oil to a no flow strategy. In one embodiment, the no flow strategy comprises halting engine oil flow. In this way, engine oil may sit in the lines and thermally communicate with the coolant in the cylinder head coolant jacket. That way, a portion of engine oil may be rapidly heated, which may decrease a duration of the cold-start.

The method 400 proceeds to 412, which includes determining if an oil temperature is greater than a threshold oil temperature. In one example, the threshold oil temperature is identical to the engine threshold temperature. In another example, the threshold oil temperature is based on a desired engine operating temperature (e.g., 180-200° F.). In one example, the oil temperature sense corresponds to an engine oil temperature of engine oil in the lines in thermal communication with coolant in the cylinder head coolant jacket.

If the engine oil temperature is not greater than the threshold oil temperature, then the method 400 proceeds to 414, which includes maintaining the no flow strategy. As such, coolant and oil pumps remain deactivated.

If the engine oil temperature is greater than the threshold oil temperature, then the method 400 proceeds to 416, which includes flowing coolant and oil through their respective passages. As such, the cold-start is done and coolant and engine oil flow may resume. As such, the coolant pump and the engine oil pump are reactivated.

In this way, a cooling arrangement comprises a cylinder head cooling jacket through which a plurality of engine oil passages traverse. The plurality of engine oil passages is sealed from coolant in the cylinder head cooling jacket while being able to thermally communicate therewith. The technical effect of the plurality of engine oil passages traversing the cylinder head cooling is to heat engine oil more quickly, which may reduce a cold-start duration.

In one example, a liquid-cooled internal combustion engine comprising at least one cylinder with at least one cylinder head and one cylinder block further comprises where each cylinder has at least one inlet opening for the supply of fresh air via an intake system and at least one outlet opening for the discharge of the exhaust gases via an exhaust-gas discharge system, each inlet opening being adjoined by an intake line and each outlet opening being adjoined by an exhaust line. The engine further comprises where the at least one cylinder head is equipped with at least one integrated coolant jacket, said at least one cylinder-head-associated coolant jacket having, at the inlet side, a supply opening for the feed of coolant and, at the outlet side, a discharge opening for the discharge of the coolant. The discharge opening is connected to the supply opening so as to form a coolant circuit, the coolant circuit being equipped with a coolant control unit, and a pump serves for conveying engine oil, specifically via the feed line to at least one consumer within an oil circuit, wherein the oil circuit has a line system with at least one line, at least one line of the line system being arranged in a cylinder-head-associated coolant jacket such that said at least one line is, at least in certain portions, surrounded over a full periphery by coolant.

A first example of the engine further includes where the line system comprises a plurality of lines.

A second example of the engine, optionally including the first example, further includes where multiple lines have an identical orientation.

A third example of the engine, optionally including one or more of the previous examples, further includes where multiple lines are arranged spaced apart from one another.

A fourth example of the engine, optionally including one or more of the previous examples, further includes where multiple lines are fluidically connected to one another.

A fifth example of the engine, optionally including one or more of the previous examples, further includes where multiple lines merge to form a common line.

A sixth example of the engine, optionally including one or more of the previous examples, further includes where multiple lines are connected to one another using individual intermediate elements and form a coherent structure.

A seventh example of the engine, optionally including one or more of the previous examples, further includes where the intermediate elements are of rib-like form.

An eighth example of the engine, optionally including one or more of the previous examples, further includes where the intermediate elements are of web-like form.

A ninth example of the engine, optionally including one or more of the previous examples, further includes where each case two adjacent lines are connected to one another using two or more intermediate elements, two adjacent intermediate elements being arranged spaced apart from one another.

A tenth example of the engine, optionally including one or more of the previous examples, further includes where at least one line of the line system is arranged in a region of the cylinder-head-associated coolant jacket which extends adjacent to the exhaust-gas discharge system.

An eleventh example of the engine, optionally including one or more of the previous examples, further includes where at least one line of the line system is arranged in a region of the cylinder-head-associated coolant jacket which extends along an exhaust line.

A twelfth example of the engine, optionally including one or more of the previous examples, further includes where the at least one cylinder head has at least two outlet openings, each outlet opening being adjoined by an exhaust line, characterized in that the exhaust lines merge to form an overall exhaust line within the cylinder head, thus forming an integrated exhaust manifold.

A thirteenth example of the engine, optionally including one or more of the previous examples, further includes where the at least one cylinder head is connectable at an assembly end side to the cylinder block, characterized in that the at least one cylinder head has a lower coolant jacket, which is arranged between the exhaust lines and the assembly end side of the cylinder head, and an upper coolant jacket, which is arranged on that side of the exhaust lines which is situated opposite the lower coolant jacket.

A method for operating a liquid-cooled internal combustion engine according to any of the preceding claims, characterized in that, after a cold start and/or in a warm-up phase of the internal combustion engine, a no-flow strategy with regard to the at least one cylinder head is implemented using the coolant control unit, in which no-flow strategy the coolant in the at least one cylinder-head-associated coolant jacket does not circulate but is at a standstill.

A first example of the method further includes where after a cold start and/or in a warm-up phase of the internal combustion engine, a no-flow strategy with regard to the line system is implemented, in which no-flow strategy the engine oil in the line system does not circulate but is at a standstill.

A second example of the method, optionally including the first example, further includes where after a cold start and/or in a warm-up phase of the internal combustion engine, a no-flow strategy with regard to the oil circuit is implemented using the pump, in which no-flow strategy the engine oil in the oil circuit does not circulate but is at a standstill.

A third example of the method, optionally including one or more of the previous examples, further includes where the no-flow strategy is ended as soon as the temperature of the coolant overshoots a predefinable coolant temperature.

A fourth example of the method, optionally including one or more of the previous examples, further includes where the no-flow strategy is implemented again as soon as the temperature of the engine oil overshoots a predefinable oil temperature.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising: an engine oil passage extending through a cylinder head coolant jacket comprising a plurality of lines fluidly separated from one another and coolant in the cylinder head coolant jacket; an intermediate element physically coupled to adjacent lines of the plurality of lines at opposite extreme ends; a cylinder head exhaust passage adjacent to the cylinder head cooling jacket; and a cylinder head surface separates the cylinder head cooling jacket from the cylinder head exhaust passage.

2. The system of claim 1, wherein the intermediate element is hermetically sealed, and wherein engine oil and coolant are blocked from flowing therethrough.

3. The system of claim 1, wherein an oil flow through the engine oil passage is normal to a coolant flow through the cylinder head coolant jacket.

4. The system of claim 1, wherein the engine oil passage extends through only the cylinder head coolant jacket.

5. An engine cooling system, comprising: a coolant chamber arranged in a cylinder head adjacent to an exhaust passage, wherein a wall of the coolant chamber fluidly separates the coolant chamber from the exhaust passage; an engine oil passage dividing from a single passage outside of the coolant chamber to a plurality of passages within the coolant chamber; a plurality of intermediate elements physically coupled to the plurality of passages, the plurality of passages comprising outer passages and inner passages, wherein more of the plurality of intermediate elements are physically coupled to the inner passages than the outer passages; and a controller with computer-readable instructions stored on non-transitory memory thereof that when executed enable the controller to: stop coolant flow in the coolant chamber and oil flow in the plurality of passages in response to a cold-start occurring.

6. The engine cooling system of claim 5, wherein the plurality of intermediate elements is oriented normally to one another.

7. The engine cooling system of claim 5, wherein the plurality of intermediate elements is fluidly separated from the plurality of passages and the coolant chamber.

8. The engine cooling system of claim 5, wherein the plurality of passages is in thermal communication with coolant in the coolant chamber.

9. The engine cooling system of claim 5, wherein oil in the plurality of passages does not mix with coolant in the coolant chamber.

10. The engine cooling system of claim 5, wherein the plurality of passages is arranged in a symmetric matrix.

11. A system, comprising: a cylinder head coolant chamber separated from an exhaust passage via a cylinder head wall; a plurality of engine oil passages extending through the cylinder head coolant chamber, wherein mixing of an engine oil in the plurality of engine oil passages and a coolant in the cylinder head coolant chamber is blocked; a single oil passage is arranged outside of the cylinder head coolant chamber, and the single oil passage divides into the plurality of engine oil passages outside of an outer walls of the cylinder head coolant;

a space between the plurality of passages where coolant flows through; and a plurality of intermediate elements is physically coupled to the plurality of passages and arranged in the space.

12. The system of claim 11, wherein the engine oil is different than the coolant.

13. The system of claim 11, wherein the coolant flows in a first direction normal to a second direction in which the engine oil through the plurality of engine oil passages flows.

* * * * *